US006935524B2

(12) United States Patent
Wilhite

(10) Patent No.: US 6,935,524 B2
(45) Date of Patent: Aug. 30, 2005

(54) DEPRESSURIZING PUMP ASSEMBLIES AND CLOSURES FOR BEVERAGE CONTAINER

(76) Inventor: Gerald Wilhite, 3 Glendale Ct., Trophy Club, TX (US) 76262

( * ) Notice: Subject to any disclaimer, the term of this patent is extended or adjusted under 35 U.S.C. 154(b) by 343 days.

(21) Appl. No.: 10/178,944

(22) Filed: Jun. 24, 2002

(65) Prior Publication Data

US 2003/0209546 A1 Nov. 13, 2003

(Under 37 CFR 1.47)

Related U.S. Application Data

(60) Provisional application No. 60/300,320, filed on Jun. 22, 2001.

(51) Int. Cl.[7] ..... B65D 51/24
(52) U.S. Cl. ..... 215/228; 220/212; 141/64
(58) Field of Search ..... 220/212, 212.5, 220/231; 215/228; 141/64; 99/467–472

(56) References Cited

U.S. PATENT DOCUMENTS 2,680,477 A * 6/1954 Schira, Jr. ..... 220/212
3,602,387 A * 8/1971 Patnaude et al. ..... 215/228
4,033,091 A * 7/1977 Saponara ..... 215/228
4,640,426 A * 2/1987 Wasley ..... 215/228
4,889,250 A 12/1989 Beyer
5,779,082 A * 7/1998 Miramon ..... 220/212
5,823,372 A * 10/1998 Levine ..... 215/228
6,352,165 B1 * 3/2002 DiFelice ..... 215/228
6,409,033 B1 * 6/2002 Wilhite et al. ..... 215/228
6,637,321 B2 * 10/2003 Wang ..... 215/228

* cited by examiner

*Primary Examiner*—Nathan J. Newhouse
(74) *Attorney, Agent, or Firm*—Edward D. Gilhooly

(57) ABSTRACT

An assemlby for depressurizing an opened beverage bottle including a bottle closure having a valve to permit depressurization of the bottle by a removable pump assembly. The pump assembly includes a stretchable diaphragm having roller being moveable on tracks within a housing. A pivotal actuator stretches the diaphragm to cause expansion of diaphragm chamber and effect depressurization of the bottle through the closure valve.

16 Claims, 14 Drawing Sheets

DEPRESSURIZING PUMP ASSEMBLIES AND CLOSURES FOR BEVERAGE CONTAINER

This application claims priority benefit of the filing date of U.S. Provisional application Ser. No. 60/300,320 filed Jun. 22, 2001.

BACKGROUND OF THE INVENTION

1. Field of the Invention

This invention relates in general to beverage bottles and, in particular, to depressurizing pumps and beverage bottle closures for extending the quality of a beverage within a bottle after previously being opened.

2. Summary of the Prior Art

Beverages are sealed for sale in plastic or glass bottles having a range of sizes. After the original bottling for initial sale, the bottles contain a void which is pressurized in the case of carbonated beverages and evacuated in the case of fermented beverages. The quality and taste of certain beverages, such as wine, deteriorates after the bottle is opened due to oxygen in the air. This problem is not effectively alleviated by re-corking the bottle after opening, because air is trapped within the void in the bottle to reduce the palatable lifetime of the beverage . . . In the case of wine, opened bottles of the beverage are commonly stored with nitrogen, which reduces the effects of oxygen and increases storage life. Nitrogen techniques to store opened bottles of wine are not convenient to use and do not achieve optimum results.

Another technique in the prior art employs depressurizing devices that act to significantly reduce oxygen levels within a resealed beverage bottle. Many past pumps and other devices for depressurizing and resealing beverage bottles are difficult to use and do not provide optimum evacuation and resealing. The designs of known evaluating devices are further expensive to manufacture and possess unnecessary complicated mechanical designs. It is therefore desirable in the prior art to provide an effective depressurizing pump assembly and closure for beverage containers.

SUMMARY OF THE INVENTION

It is therefore an objective of the invention to provide two embodiments of improved depressurizing pump assemblies and closures for evacuating and resealing an opened beverage bottle. The pumps herein are capable of significantly reducing the oxygen levels within the void of the bottle to a near vacuum condition. The closures effectively reseal the bottle to preserve the evacuated state within the bottle created by the pump. In a first embodiment of the invention, the closure includes two valves, one of which allows air to be withdrawn from the bottle and the second allows air that was withdrawn from the bottle to be released from the pump. In a second embodiment of the invention, the closure includes a single valve operating in concert with a valve provided on the housing of the pump. The pumps employ an effective diaphragm design which is capable of evacuating the air in the bottle in a minimum number of manual strokes. The diaphragm of the pump assemblies herein serves the dual function of acting as a seal with the bottle when the pump is mounted thereon and a pump element as the diaphragm is stretched during a pumping stroke.

DESCRIPTION OF THE PREFERRED EMBODIMENTS

Figure 1:
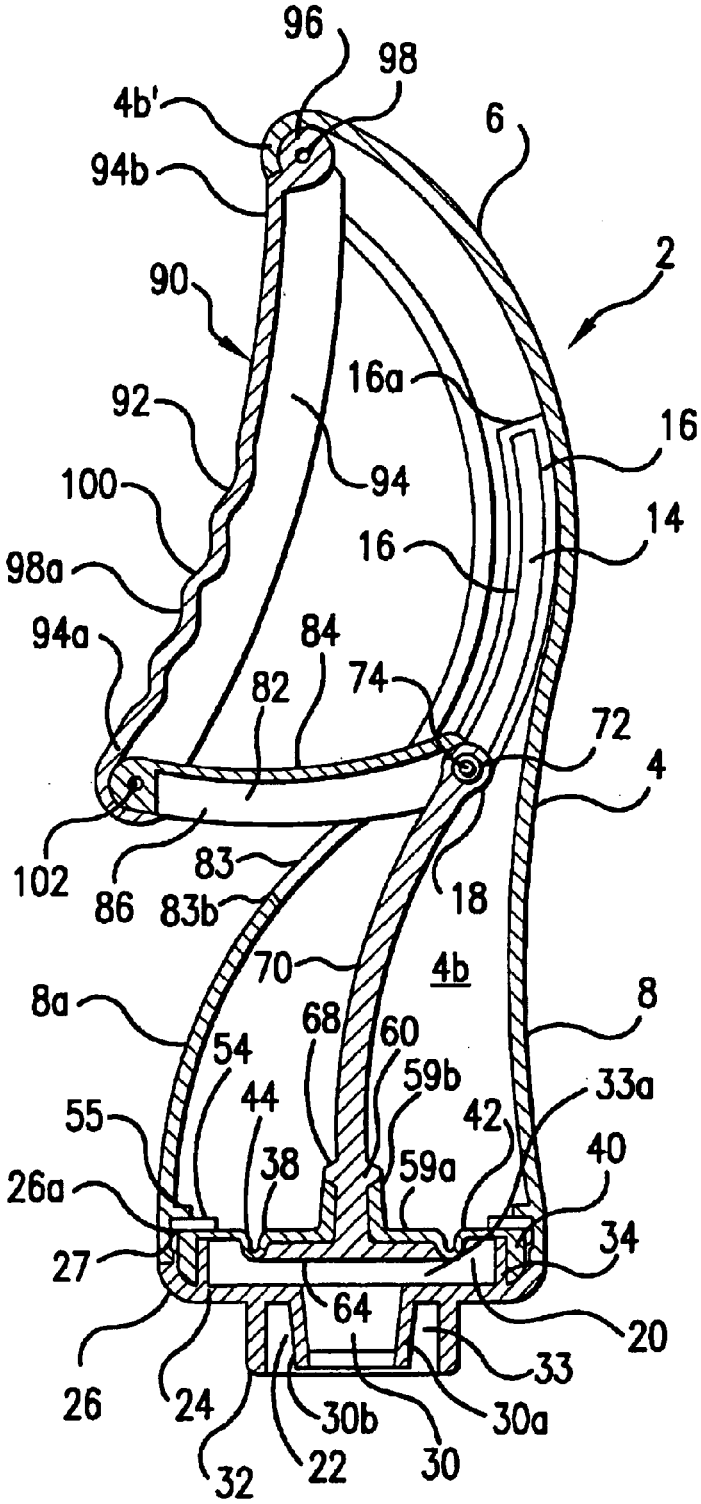
FIG. 1 is a side elevational view, with a housing half removed and parts in section, of a first embodiment of the depressurizing pump assembly of the invention.

Referring now to FIGS. 1–10, there is illustrated a first embodiment of the depressurizing pump assembly for beverage bottles, generally designated by reference numeral 2. As seen in FIGS. 1–4, pump assembly 2 includes a housing 4 that is formed by identical halves 4*a* (FIGS. 1–3) suitably affixed together by an adhesive or mechanical fasteners. The housing 4 forms a hollow interior portion 4*b*. The housing 4 is provided with a curved upper portion 6 and a lower portion 8 having bulging curved walls 8*a*. Aligned divider walls 10 internally separate upper portion 6 from lower portion 8. As seen FIGS. 2 and 4, a pair curved tracks 14 are formed on the interior wall of housing halves 4*a* in the upper housing portion 6. The tracks 14 are each defined by spaced projecting continuous sections 16 having an enclosed upper end 16*a* and a closed end 18 as seen in FIGS. 1–4. The housing halves 4*a* include angled walls 4*b*' to enclose the upper end of the housing 4. Although the housing can be formed from any suitable material, housing 4 is shown as being fabricated from a durable plastic.

Figure 2:
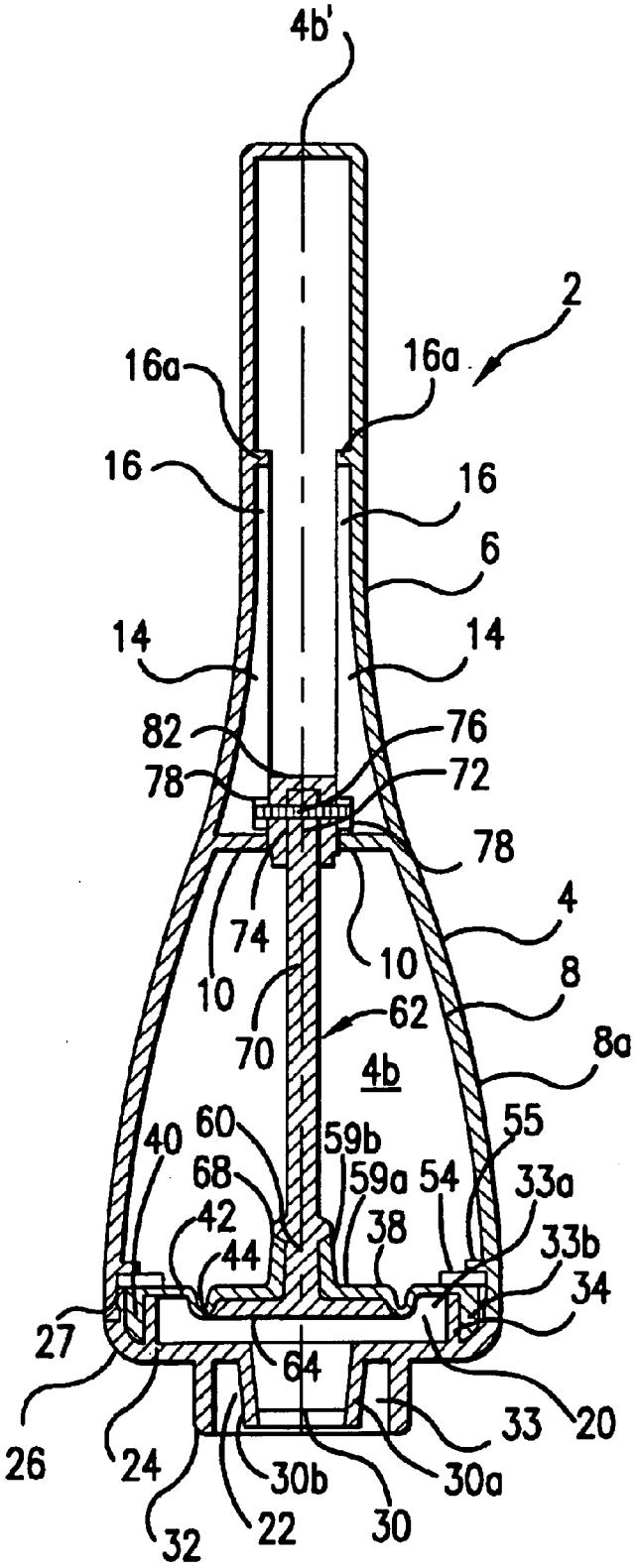
FIG. 2 is a front elevational view, with parts removed and parts in section, of the depressurizing pump of FIG. 1.
Figure 6:
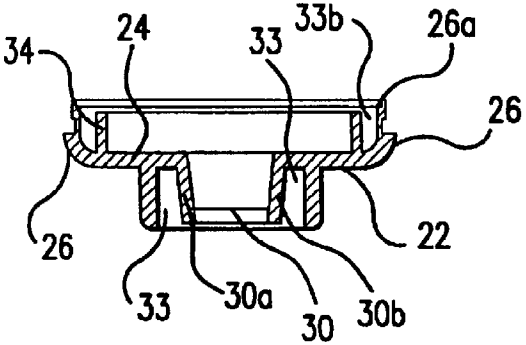
FIG. 6 is a side elevational view, with parts in section, of the base of the pump assembly of FIG. 1.

The lower end 20 of housing 4 is open to which a base 22 formed from a plastic and the like is secured by a suitable technique, such as by an adhesive or mechanical fasteners or welds. As shown in FIGS. 1 and 6, the base 22 includes a lower wall 24 having integral upright portions 26 that are secured to the bottom of housing 4. The upright portion 26 includes an upper edge portion 26*a* that is inserted in housing 4. A retainer ring 27 is positioned on corresponding grooves in upper edge portion 26*a* and housing 4 to retain the base 22 to the housing 4. Both the base 22 and the housing 4 include a matching circular cross-section at the bottom. A central passage 30 is formed by downward hollow projection 30*a* having an inverted frusto-conical continuous wall 30*b*. A cylindrical projection 32 is integral to wall 24 and concentrically surrounds inner projection 30*a* to create a lower opening 33 that receives a portion of the bottle closure of the invention in use as will be described. As seen in FIGS. 1 and 2 the central passage 30 is in filud communication with diaphragm lower chamber 33*a*. A continuous circular ridge 34 is integral to base 22 and forms a continuous space 33*b* within housing 4.

Figure 5:
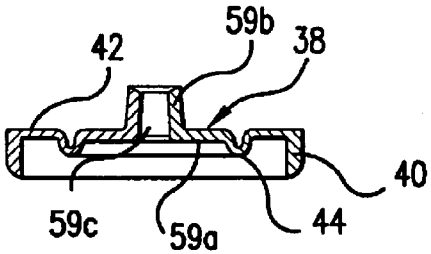
FIG. 5 is a side elevational view, with parts in section, of the pump diaphragm of the pump assembly of FIG. 1.

As seen in FIGS. 1, 2,and 5, a stretchable diaphragm 38 is mounted in housing 4 and is fabricated from silicone or other material capable of bulging upward when stretched by a mechanical force and returning to a normal shape as shown in FIGS. 1 and 2 when the mechanical force is substantially removed. The diaphragm 38 is circular in cross-section and its outer periphery is defined by a continuous peripheral section 40 which extends downward into space 33*b*. A stretchable diaphragm wall 42 integrally extends from outer ring section 40 to enclose the lower diaphragm chamber 33*a*. The diaphragm wall 42 is provided with a continuous groove 44 (FIG. 5) to increase flexibility of the diaphragm 38. The diaphragm periphery 40 may be secured by an adhesive within space 33*b* and is otherwise secured to the housing 4 by a diaphragm retainer ring 54 (FIGS. 1 and 2) which bears in secured relationship against the upper surface of ring 40 and the lower surface of ledge 55 formed on the interior surface of housing 4. The retainer 54 has a lower protuberance 56 that inter-fits with a groove 58 in periphery 40.

The central portion 59 of diaphragm 38 is provided with a central horizontal portion 59*a* and upward hollow cylindrical projection 59*b* forming opening 59*c*. The lower portion of a diaphragm holder 62 extends through diaphragm opening 59*c*. The securement portion 60 of diaphragm holder 62 has a lower expanded end 64 biased against diaphragm wall 59*a* in secured relationship. A continuous lip 68 projects from diaphragm holder 60 to contact the top of diaphragm portion 59*b* for further securement.

The diaphragm holder 62 is fabricated from a suitably strong and flexible material, such as, for example, nylon and has a curved upper upright section 70 terminating with a securement formation 72 having hole 74. A metal shaft 76, such as formed from stainless steel, plastic, or other material, extends through hole 74. Rollers 78 (FIG. 2) are rotatably secured to opposite ends of shaft 76 by a known technique. The rollers 78 respectively project in between curved walls 16 of the housing halves 4*a*, such that the rollers follow the track curvature defined by track 14 to cause the diaphragm 38 to flex upward and expand diaphragm chamber 33*a* in conformance to the movement of rollers 76.

Figure 3:
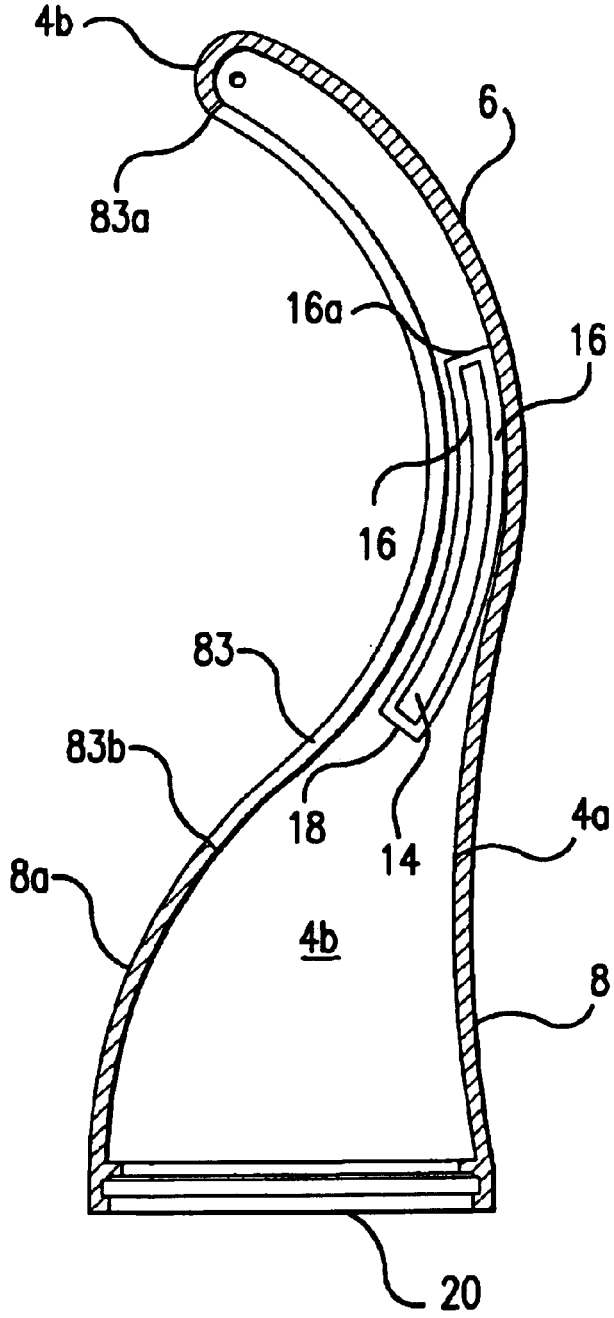
FIG. 3 is a side elevational view of a half of the housing of the depressurizing pump assembly of FIG. 1.
Figure 4:
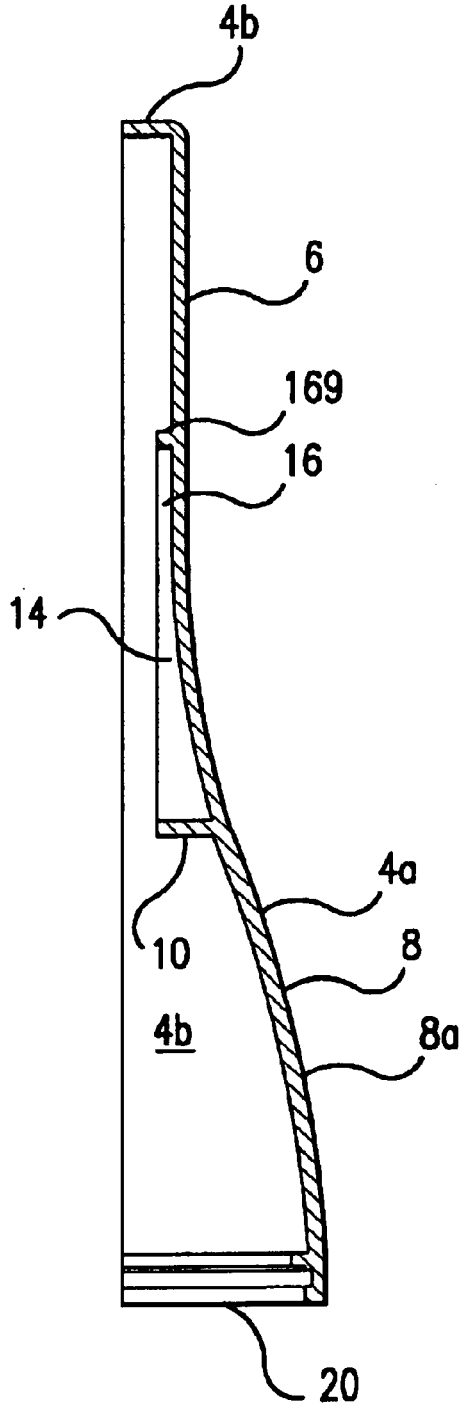
FIG. 4 is a front elevational view of the housing half of FIG. 3.
Figure 9:
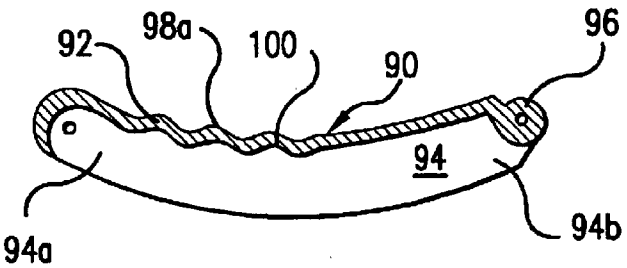
FIG. 9 is a side elevational view, with parts in section, of the pump lever of the pump assembly of FIG. 1.
Figure 8:
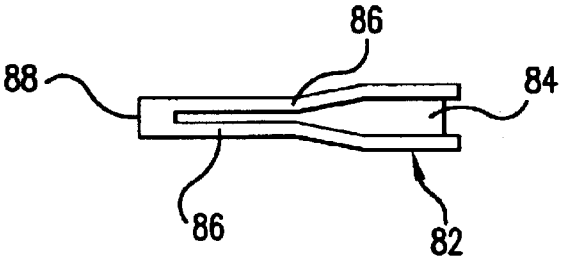
FIG. 8 is a bottom plan view of the lever arm of FIG. 7.

As best seen in FIGS. 1, 2, 7, and 8, a lever arm 82 is pivotally secured to the shaft 76 and extends exteriorly through a narrow opening 83 in housing 4 continuously provided between upper edge 83*a* and lower edge 83*b* cut in housing 4 (FIGS. 1 and 3). The lever arm 82 possesses a slightly bowed U-shape defined by upper wall 84, spaced side walls 86 and securement end 88. As best seen in FIG. 8, the inner portion of side walls 86 are spaced by greater distance than the outer portion of side walls 86 so as to overlap the upper end of the diaphragm holder (FIG. 2). A pump lever 90 is secured at its lower end to the securement end 88 of lever arm 82 as will be described.

Figure 10:
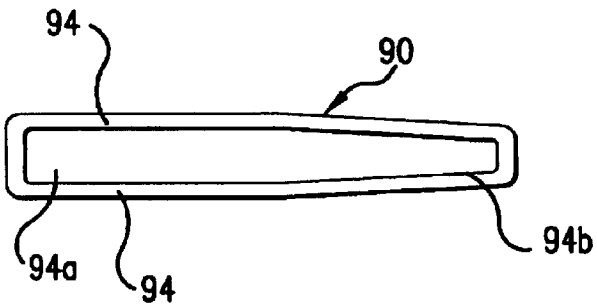
FIG. 10 is back elevational view of the pump lever of FIG. 9.
Figure 7:
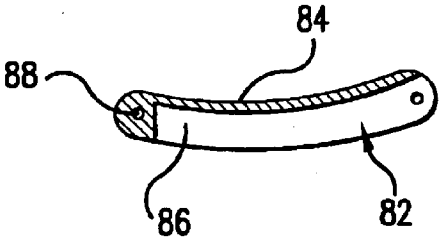
FIG. 7 is a side elevational view, with parts in section, of the lever arm of the pump assembly of FIG. 1.

As seen in FIGS. 1 and 10, the pump lever 90 also possesses a bowed configuration created by curved outer wall 92 which interconnects a pair of projecting spaced side walls 94. As seen in FIG. 10, the spaced side walls 94 are parallel in lower end 94*a* while the spaced side walls 94 taper toward end other in spaced relationship at upper end 94*a* and terminate with securement end 96 to pivotally attach lever 90 to housing 4 by a pin 98 (FIG. 1). A portion 98*a* of the curved outer wall 92 has an undulated shape to form a gripping surface 100 to actuate the pump. The lower end of pump lever 90 is pivotally secured to the outer end of lever by a pin 102 projecting through side walls 94 and the pump lever end positioned therebetween.

Figure 11:
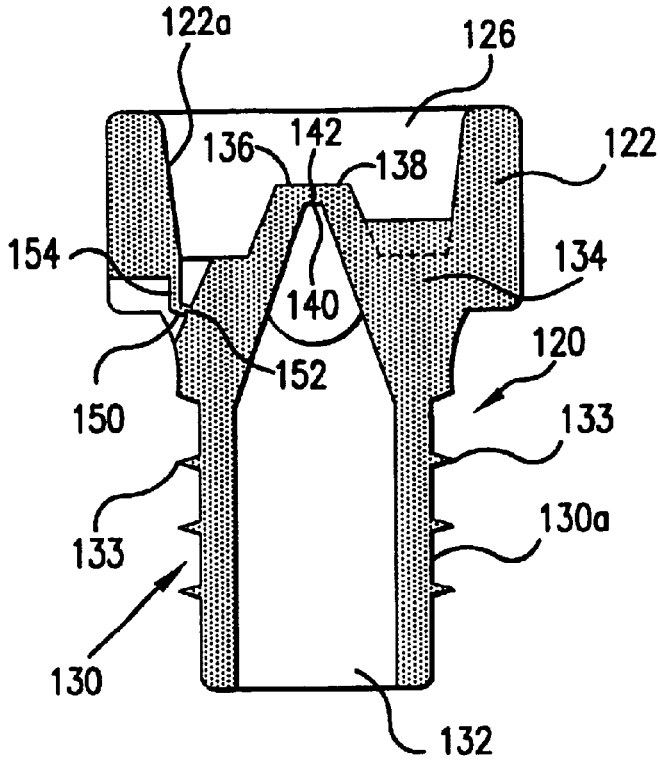
FIG. 11 is a side elevational view of the valved bottle closure for use with the pump assembly of FIG. 1.
Figure 12:
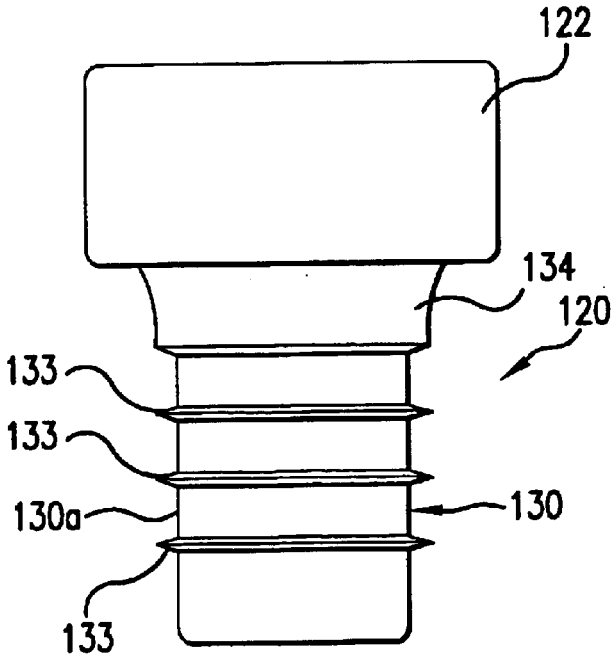
FIG. 12 is a side elevational view, with parts in section, of the valved bottle closure of FIG. 7.

Referring to FIGS. 11 and 12, there is illustrated the beverage bottle closure, generally designated by reference numeral 120. The upper portion 122 of closure 120 is formed by an enlarged circumferentially extending circular wall 124 to surround an upper cavity 126. The upper portion 122 may be gripped to insert and remove the closure in and from a bottle. The lower end 130 of closure 120 is in the form of a hollow circular projection 130*a* creating flow passage 132 which is in communication with the void within a beverage bottle when the closure 120 is inserted into the open neck. A plurality of continuous rings 133 extend around the shank of lower end 130 to engage the interior of bottle neck in a sealed relationship. The upper section of projection 130*a* is integrally formed with upper portion 122 by intermediate body portion 134. The intermediate portion 132 extends upward into cavity 126 and terminates with at apex 136 formed by a flat horizontal surface 138. The inner periphery 122*a* of closure 120 engages the outer wall 32 of base 22 to produce a seal therebetween when the pump assembly 2 is situated on the closure 120.

A first valve 140 is provided through horizontal surface 138 and is created by severed area 142 through surface 138 to passage 132. In its normal condition, the severed area 142 is resiliently biased in closed position to block the passage of flow and seal the interior of bottle. When the pump assembly 2 is positioned on closure 120 in a manner to be described to evacuate the bottle, the split area 142 separates to open the valve and permit the flow of air from the bottle void to the diaphragm chamber 33*a* of the pump assembly 2. A second valve 150 is provided at a cut-out section on intermediate portion to exhaust air from the diaphragm chamber to the atmosphere. The second valve 150 is created by a severed section 152 formed through closure wall portion 154. The closure 120 may be fabricated from silicon, Kraton, or other similarly acting material.

In operation, the pump assembly 2 is attached to a previously opened beverage bottle after the closure 120 is inserted into the neck. The pump assembly 2 is affixed to the closure 120 by inserting the inner hollow projection 30*a* of base 22 into the cavity 126. In use the pump lever 90 is squeezed such that lever arm 82 causes the rollers 78 to move upward in track 14 generally near enclosed upper end 164. The diaphragm holder 70 simultaneously pulls diaphragm 38 upward to stretch it and reduce the pressure within the diaphragm chamber 33*a*. In the upward stroke valve 150 remains closed while valve 140 of the closure 120 opens to pull air out of the bottle to evacuate the air from the bottle. Upon release of pump lever 90, the diaphragm 38 returns to its original configuration and pulls the rollers 78 downward in the track 14. On the down stroke valve 140 closes to seal the bottle and valve 150 opens to exhaust the air of diaphragm chamber 33*a*. During the upward evacuating stroke of pump assembly 2, the inner hollow projection is pressed downward in greater frictional and sealing contact with closure 120. It should be apparent the diaphragm 38 not only evacuates the bottle, but serves as a seal while the valve 140 is open. The pump assembly 2 can undergo multiple strokes if greater evacuation and depressurization of the bottle is desired. Upon depressurizing the bottle the pump assembly 2 is removed while the closure 120 is in sealed relationship on bottle whereby both valves 140 and 150 assume their normal closed mode.

Figure 15:
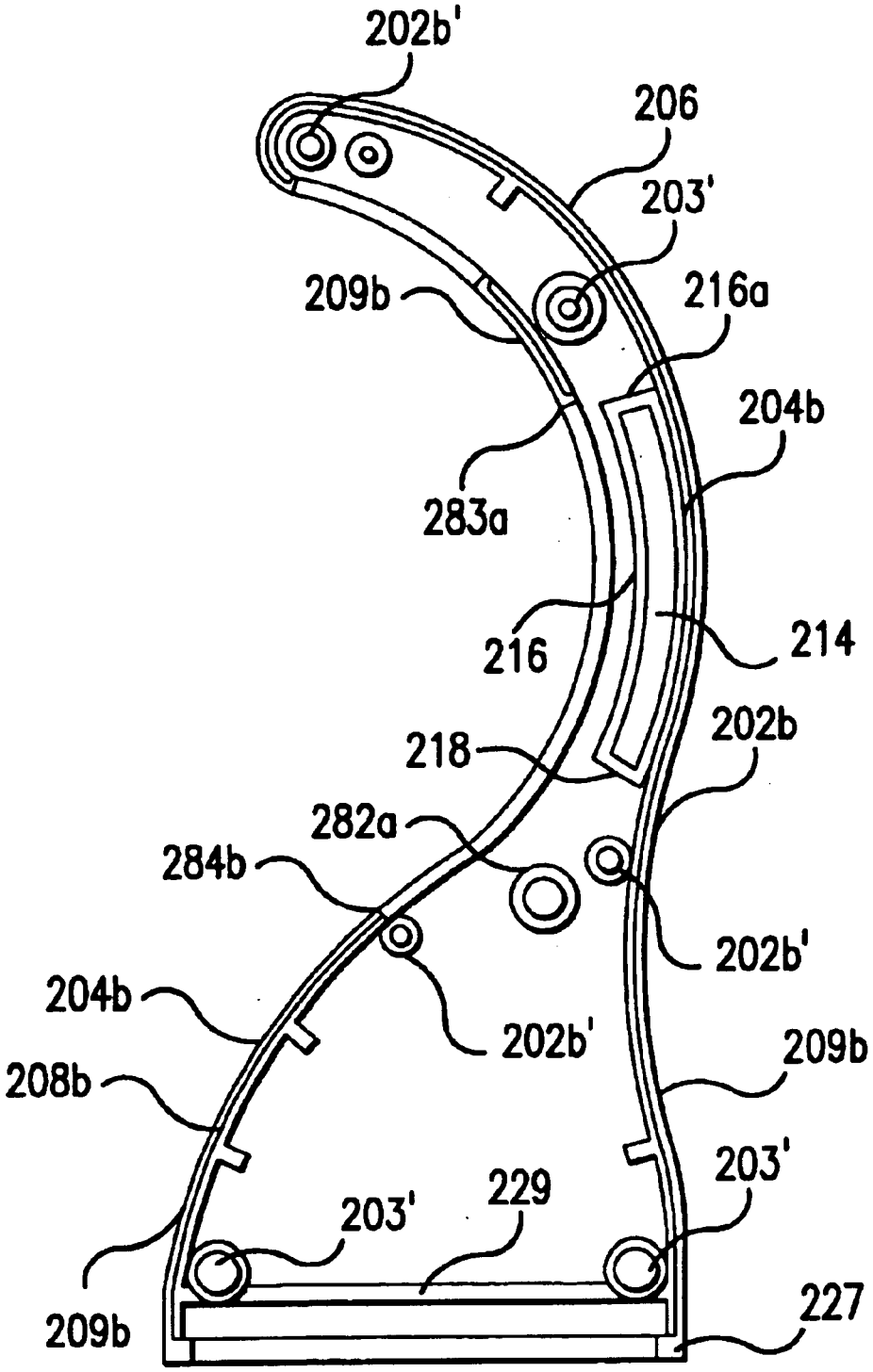
FIG. 15 is a side elevational view of a rear half of the housing of the depressurizing pump assembly of FIG. 13.
Figure 16:
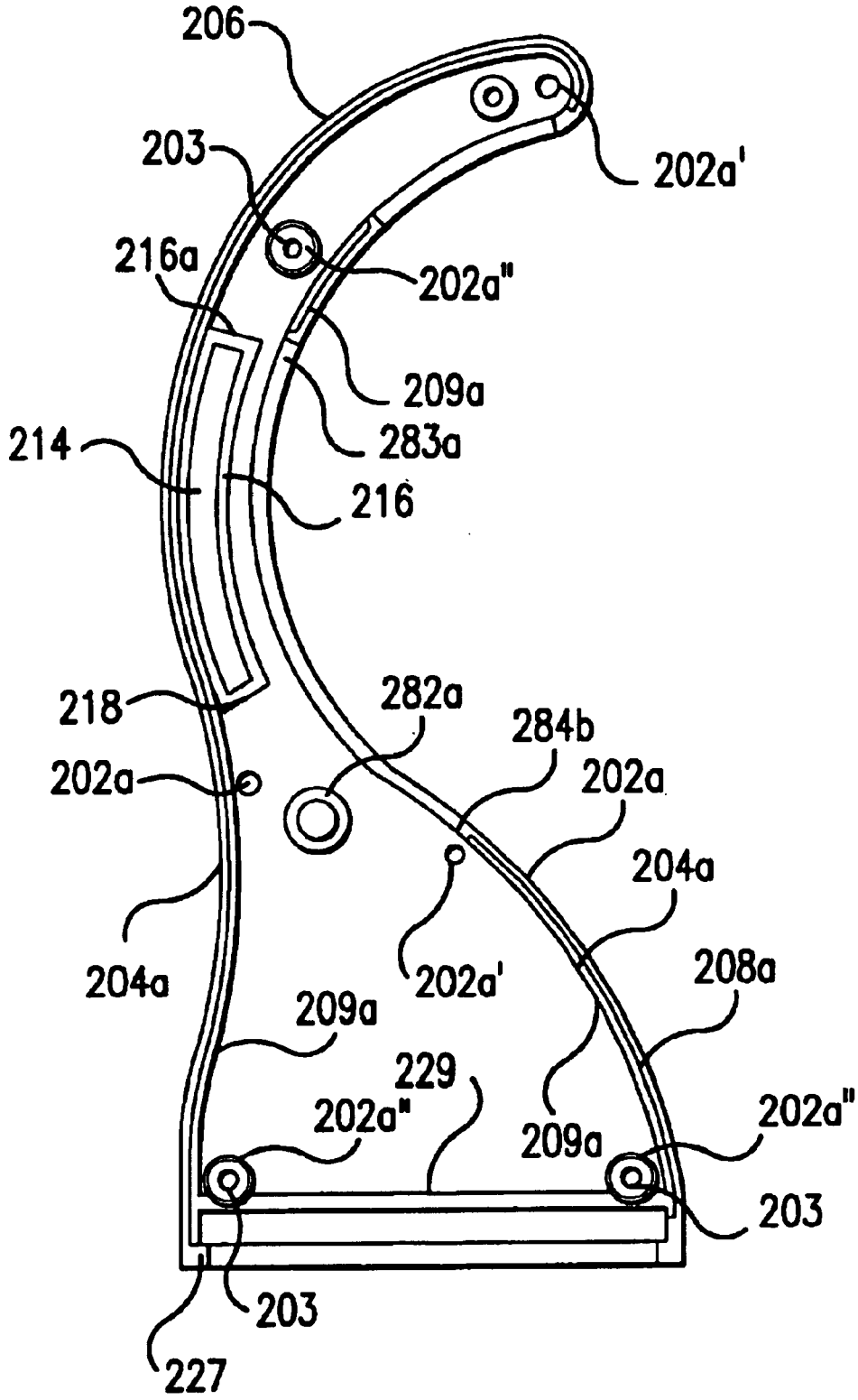
FIG. 16 is a side elevational view of the front housing half of FIG. 13.
Figure 17:
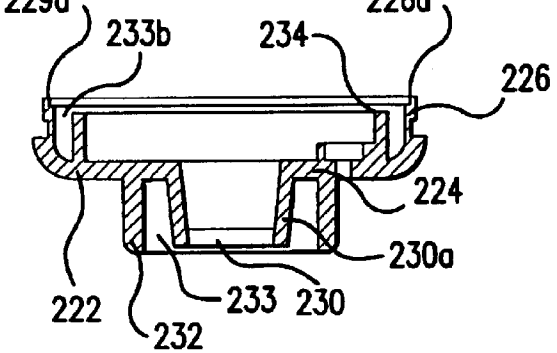
FIG. 17 is a side elevational view, with parts in section, of the base of the pump assembly of FIG. 13.
Figure 18:
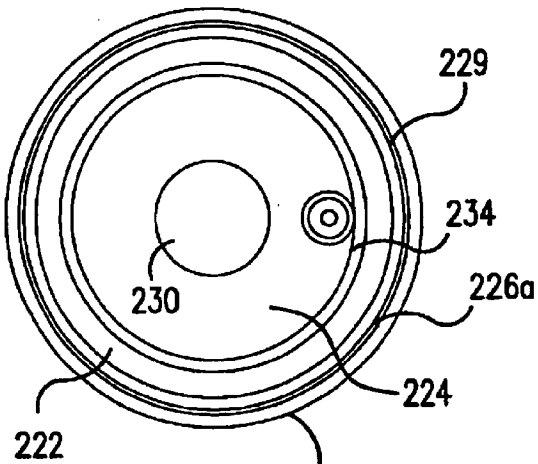
FIG. 18 is top plan view of the base of FIG. 17.
Figure 19:
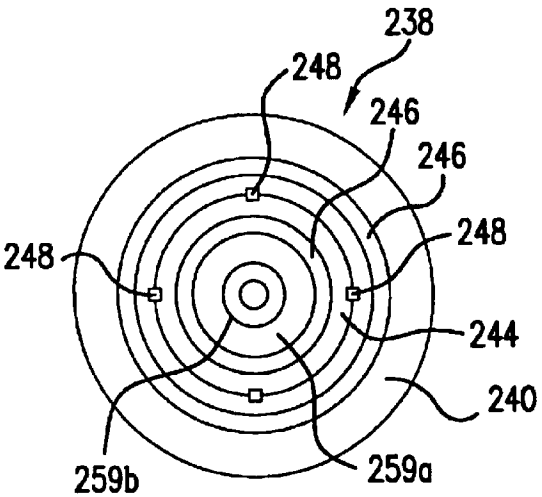
FIG. 19 is a top plan view of the diaphragm of the pump assembly of FIG. 13.
Figure 20:
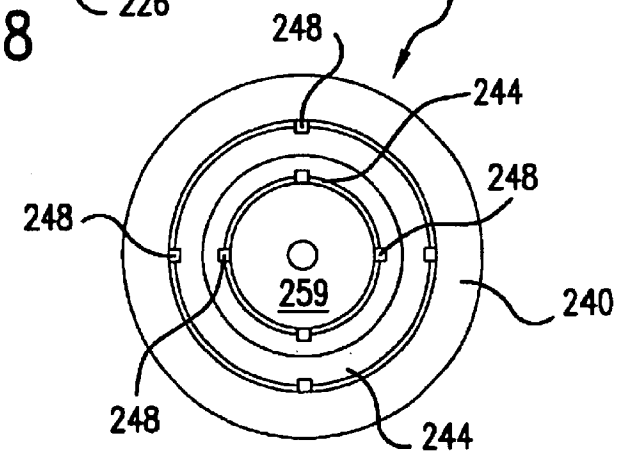
FIG. 20 is a bottom plan view of the diaphragm of FIG. 19.

Referring now to FIGS. 13–33, there is illustrated the second embodiment of the depressurizing pump assembly for beverage bottles, generally designated by reference numeral 200. As seen in FIGS. 13–16, pump assembly 200 includes a housing 202 that is formed by front and back housing halves 202*a* and 202*b* (FIGS. 13–16) suitably affixed together by an adhesive or mechanical fasteners (not shown). The housing 202 forms a hollow interior portion 202*c* when the respective edges 204*a*. and 204*b* of housing halves 202*a* and 202*b* interconnect as will be described. In FIG. 16, the front housing half 202*a* has a plurality of internal pin projections 202*a*' that project beyond the edge 204*a* of the housing half 202*a*. The pin projections 202*a*' are arranged to be inserted into hollow projections 202*b*' formed interiorly of back housing 202*b* when the halves 202*a,b* are assembled together. The hollow projections 202*b*' are positioned within back housing 202*b* so that pin projections 202*a*' are inserted into the hollow projections 202*b*' to aid in securement and support of the housing halves. In addition, front housing 202*a* has three identical posts 202*a*" projecting internally of the front housing 202*a* at the bottom and the top portion. The posts 202*a*" have narrowed projecting ends 203 in housing 202*b* that extend into hollow bases 203' formed in alignment therewith when the housing 202 is assembled for further securement and support.

The housing 202 is provided with a curved upper portion 206 and a lower portion 208 having bulging curved walls 208*a,b*. The opposed edges 204*a,b* forming bulged curved walls 208*a,b* and the edges 204*a,b* forming the convex portion 206 each have lips 209*a,b* that are offset from each other. As seen in FIGS. 15 and 16, the lips 209*a* and 209*b* contact each other in adjacent contacting sealed relationship when the halves 202*a* and 202*b* are assembled together with the lip 209*a* being with in the lip 209*b*. Offset lips 209*a*' and 209*b* are also formed on a upper section of halves 202*a* and 202*b* for further interengagement of the edges 204*a,b*. As seen FIGS. 13–16, a pair curved tracks 214 are formed on the interior wall of housing 202*a,b* in the upper housing portion 206. The tracks 214 are each defined by spaced projecting continuous sections 216 having an enclosed upper end 216*a* and a closed lower end 218 as seen in FIGS. 13–16. The housing halves 202*a,b* include angled walls 204*b*' to enclose the upper end of the housing 202. Although the housing can be formed from any suitable material, housing 202 is shown as being fabricated from a durable plastic.

Figure 13:
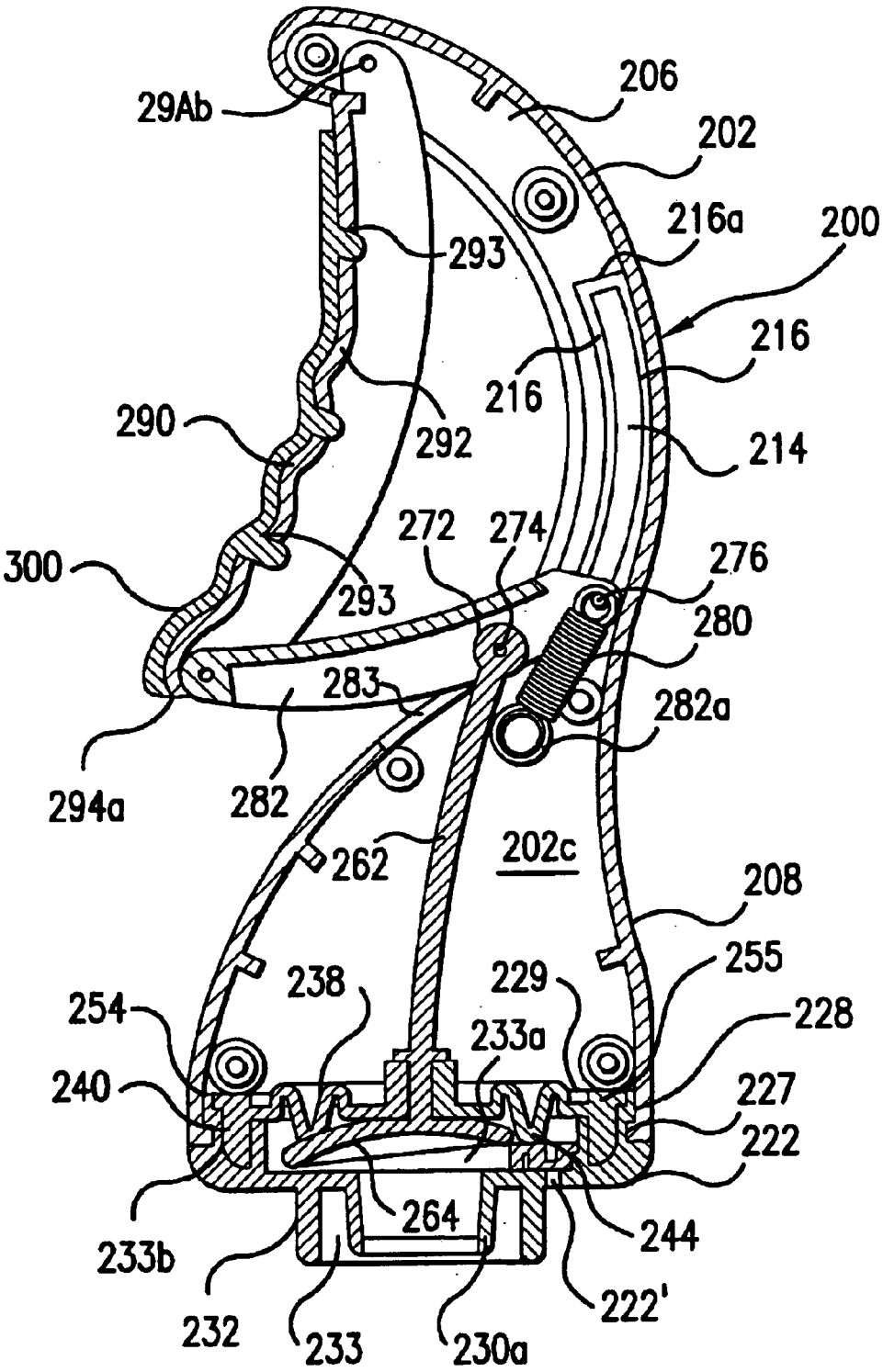
FIG. 13 is a side elevational view, with a housing half removed and parts in section, of a second embodiment of the depressurizing pump assembly of the invention.
Figure 14:
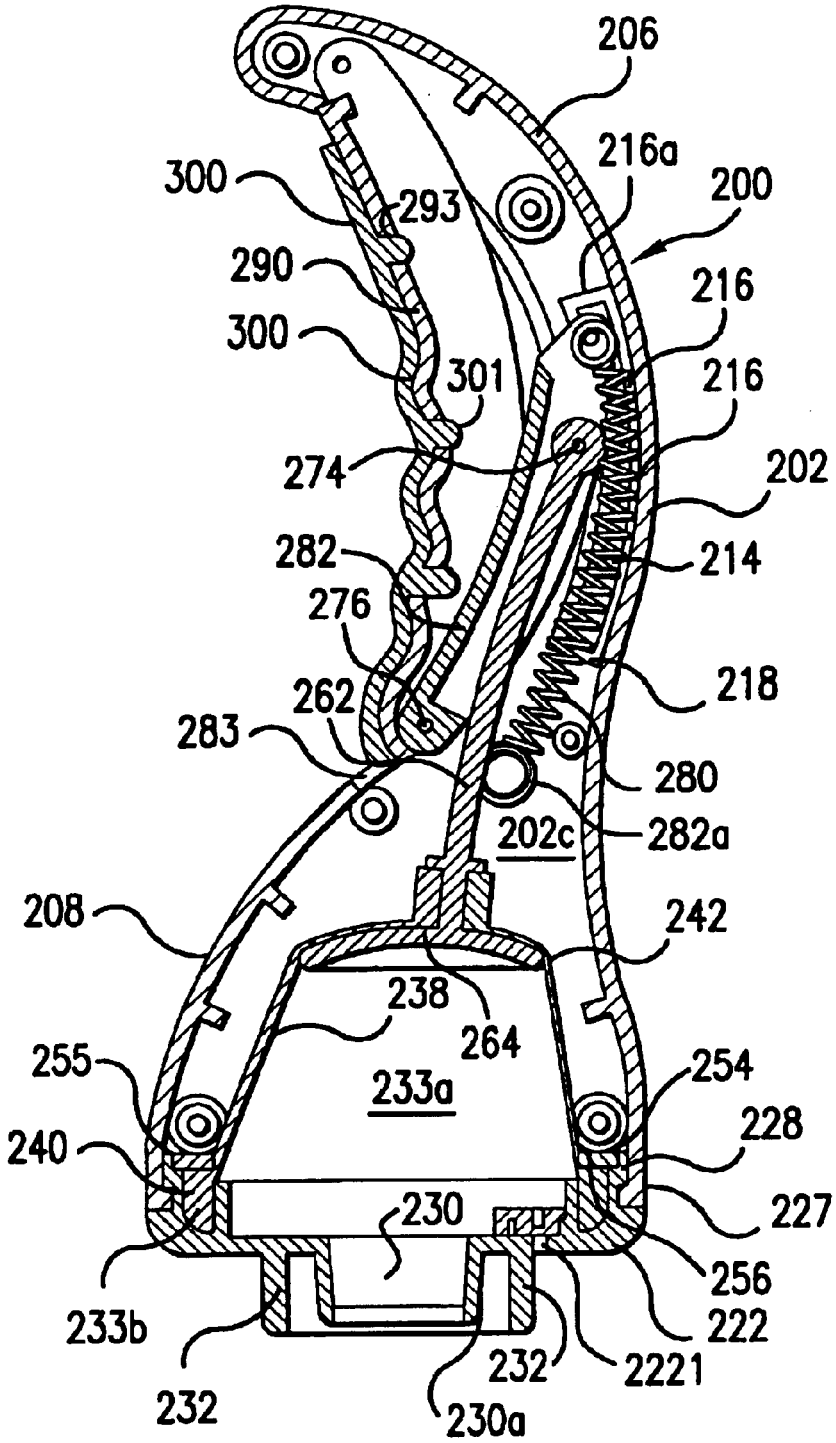
FIG. 14 is a front elevational view, with parts removed and parts in section, of the depressurizing pump of FIG. 13.

As shown in FIGS. 13, 14, 17, and 18, the lower end 220 of housing 202 is open to which a base 222 formed from a plastic and the like is secured by a suitable technique, such as by an adhesive or mechanical fasteners or welds. The base 222 includes a lower wall 224 having integral upright portions 226 that are secured to the bottom of housing 202. The upright portion 226 includes upper edge portion 226*a* that is inserted in housing 4. A retainer ledge 227 is is provided on housing 202 to retain the base 222 to the housing 202. Both the base 222 and the housing 202 include a matching circular cross-section at the bottom. A central passage 230 is formed by downward hollow projection 230*a* having an inverted frusto-conical continuous wall 230*b*. A cylindrical projection 232 is integral to wall 224 concentrically surrounds inner projection 230*a* to create a lower opening 233 that receives a portion of the bottle closure of the invention in use as will be described. As seen in FIGS. 13 and 14 the central passage 230 is in filud communication with diaphragm lower chamber 233*a*.

As seen in FIGS. 13, 14, and 19–21, a stretchable diaphragm 238 is mounted in housing 202 and is fabricated from silicone or other material capable of bulging upward when stretched by a mechanical force and returning to a normal shape as shown in FIGS. 13 and 14 when the mechanical force is substantially removed. The diaphragm 238 is circular in cross-section and its outer periphery is defined by a continuous peripheral section 240 which extends downward into space 233*b*. A stretchable diaphragm wall 242 integrally extends from outer ring section 240 to enclose the lower diaphragm chamber 233*a*. The diaphragm wall 242 is provided with a continuous groove 244 (FIGS. 19–21) to increase flexibility of the diaphragm 238. A pair of continuous grooves 246 is disposed on each side of groove 244. Ribs 248 are disposed within grooves 244,246 to assist the diaphragm 233*a* to return to its relaxed start of FIG. 13. The diaphragm periphery 240 may be secured by an adhesive within space 233*b* and is otherwise secured to the housing 202 by a diaphragm retainer ring 254 (FIGS. 13 and 14) which bears in secured relationship against the upper surface of ring 240 and the lower surface of ledge 255 formed on the interior surface of housing 202. The retainer 254 has a lower protuberance 256 that inter-fits with a groove 258 in periphery 240 of the diaphragm.

The diaphragm 238 is provided with a central horizontal portion 259*a* and upward hollow cylindrical projection 259*b* forming opening 259*c*. The lower portion of a diaphragm rod 262 extends through diaphragm opening 259*c* as seen in FIGS. 13 and 14. The securement portion 260 of diaphragm rod 262 has a lower expanded end 264 biased against diaphragm wall 259*a* in secured relationship. Continuous lip 268 projects from diaphragm holder 260 to contact the top of diaphragm portion 259*b* for further securement.

Figure 29:
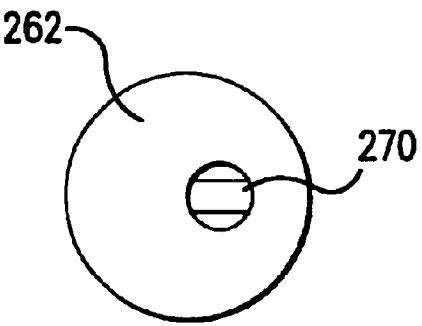
FIG. 29 is a top plan view of the diaphragm rod of FIG. 28.
Figure 28:
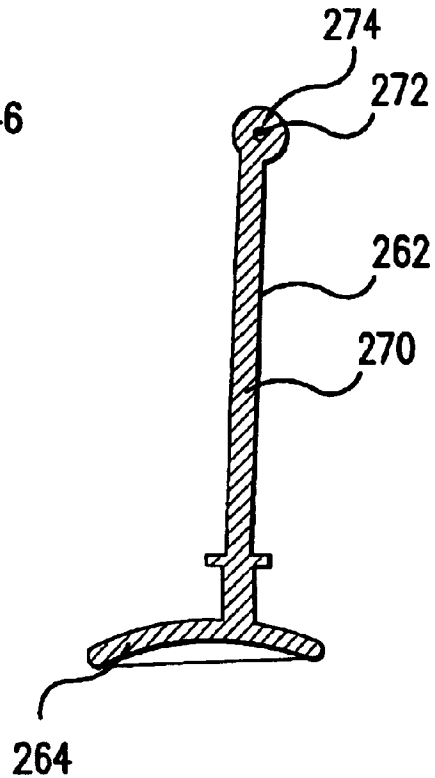
FIG. 28 is a side elevational view of the diaphragm rod of for use with the pump assembly of FIG. 13.
Figure 21:
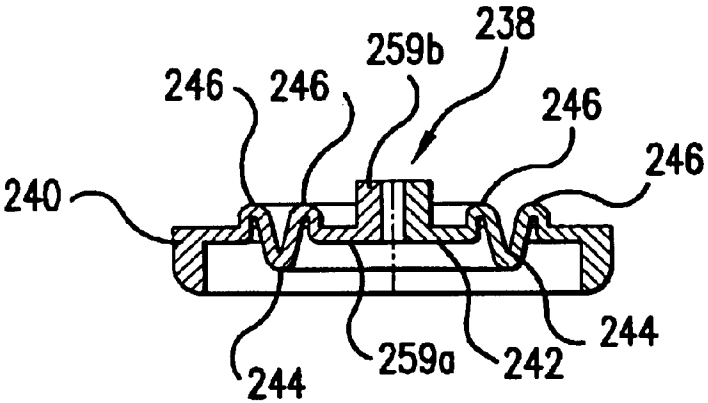
FIG. 21 is a side elevational view, with parts in section, of the diaphragm of FIG. 19.
Figure 24:
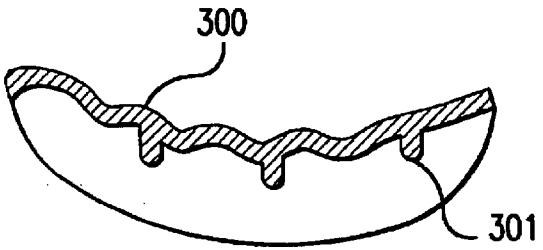
FIG. 24 is a side elevational view, with parts in section, of the pump lever cover for the pump lever of FIG. 22.

The diaphragm rod 262 is fabricated from a suitably strong and flexible material, such as, for example, nylon and has a curved upper upright section 270 terminating with a securement formation 272 having hole 274 as seen in FIGS. 28 and 29. The upright section is off-center from the convex top of the expanded end 264. A metal shaft 276, such as formed from stainless steel, plastic, or other material, extends through hole 274. Rollers (not shown) are rotatably secured to opposite ends of shaft (not shown) in a manner as described with reference to the first embodiment of the invention disclosed herein. The rollers respectively project in between curved walls 216 of the housing halves 202*a,b*, such that the rollers follow the track curvature defined by track 214 to cause the diaphragm 238 to flex upward and expand diaphragm chamber 233*a* in conformance to the movement of rollers. As illustrated in FIGS. 13 and 14, a spring 280 is attached to a pin on the lever arm 282 and a securement anchor 282*a* to remove the slack to remove slack in the diaphragm 242.

Figure 27:
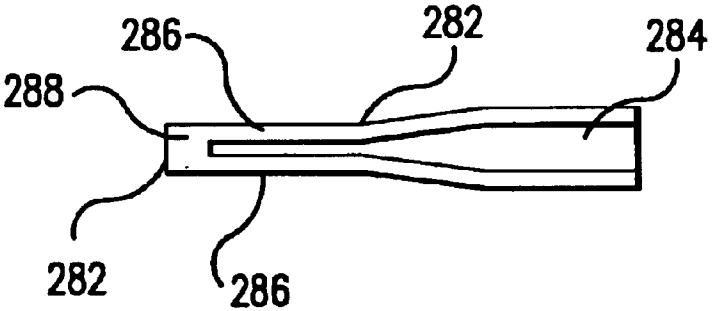
FIG. 27 is a top plan view of the rod arm of FIG. 26.
Figure 32:
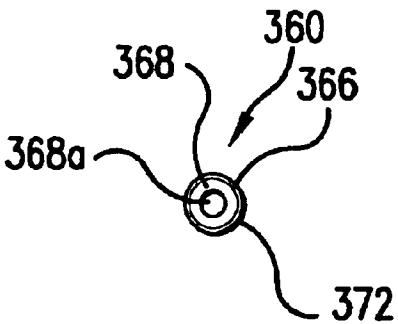
FIG. 32 is a top plan view of the valve for use with the valve cap of FIG. 30.

As best seen in FIGS. 13, 14, 26, and 27, a lever arm 282 is pivotally secured to the shaft 276 and extends exteriorly through a narrow opening 283 in housing 202 continuously provided between upper edge 283*a* and lower edge 283*b* cut in housing 202 (FIGS. 13–16). The lever arm 282 possesses a slightly bowed U-shape defined by upper wall 284, spaced sidewalls 286 and securement end 288. As best seen in FIG. 27, the inner portion of side walls 286 are spaced by greater distance than the outer portion of side walls 286 so as to overlap the upper end of the diaphragm holder (FIG. 13). A pump lever 290 is secured at its lower end to the securement end 288 of lever arm 282 as will be described.

Figure 23:
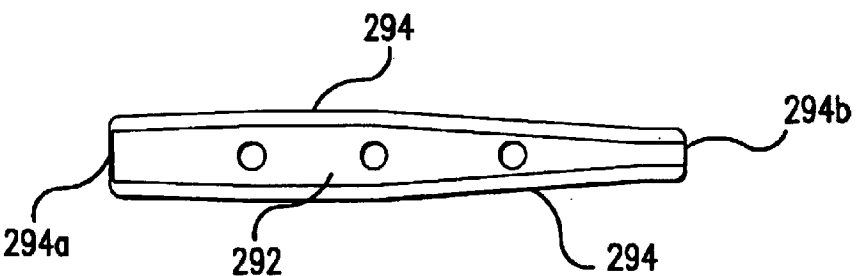
FIG. 23 is a bottom plan view of the of the pump lever of FIG. 22.
Figure 22:
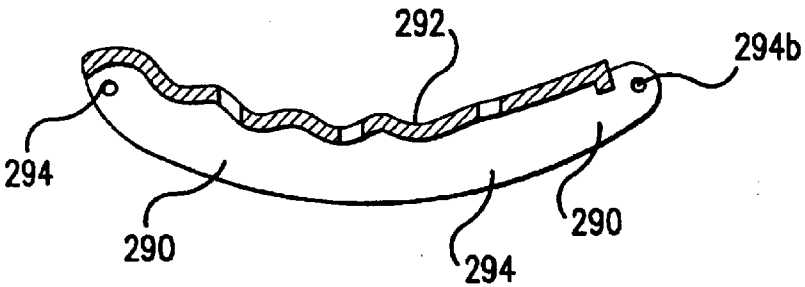
FIG. 22 is a side elevational view, with parts in section, of the pump lever for use with the pump assembly of FIG. 13.
Figure 25:
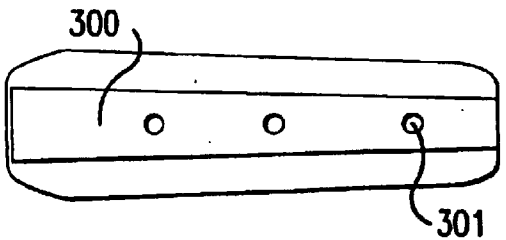
FIG. 25 is a bottom plan view of the pump lever cover of FIG. 24.

As seen in FIGS. 13, 14, 22 and 23, the pump lever 290 also possesses a bowed configuration created by curved outer wall 292 (FIG. 22) which interconnects a pair of projecting spaced sidewalls 294. As seen in FIG. 23, the spaced side walls 294 are nearly parallel in lower end 294*a* while the spaced side walls 294 taper toward end other in spaced relationship at upper end 294*a* and terminate with securement end 296 to pivotally attach lever 290 to housing 202 by a pin 298 (FIG. 13). The curved outer wall 292 has openings 293 to receive a resilient lever cover 300 (FIGS. 24 and 25) having projections 301 fitting in the openings 293 of the of pump lever 290. The lower end of pump lever 290 is pivotally secured to the outer end of lever by a pin projecting through side walls 294 and the pump lever end 290*a* positioned therebetween.

Figure 31:
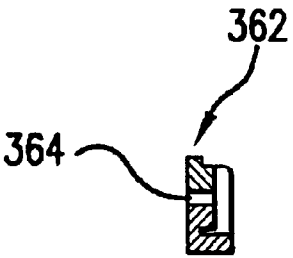
FIG. 31 is a side elevational view, with parts in section, of the valve cap of FIG. 30.
Figure 26:
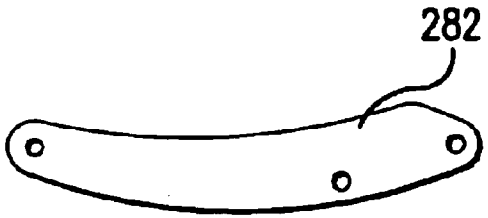
FIG. 26 is a side elevational view of the of the rod arm for the pump assembly of FIG. 25.
Figure 30:
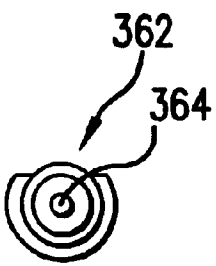
FIG. 30 is a top plan view of the valve cap for the pump assembly of FIG. 13.
Figure 33:
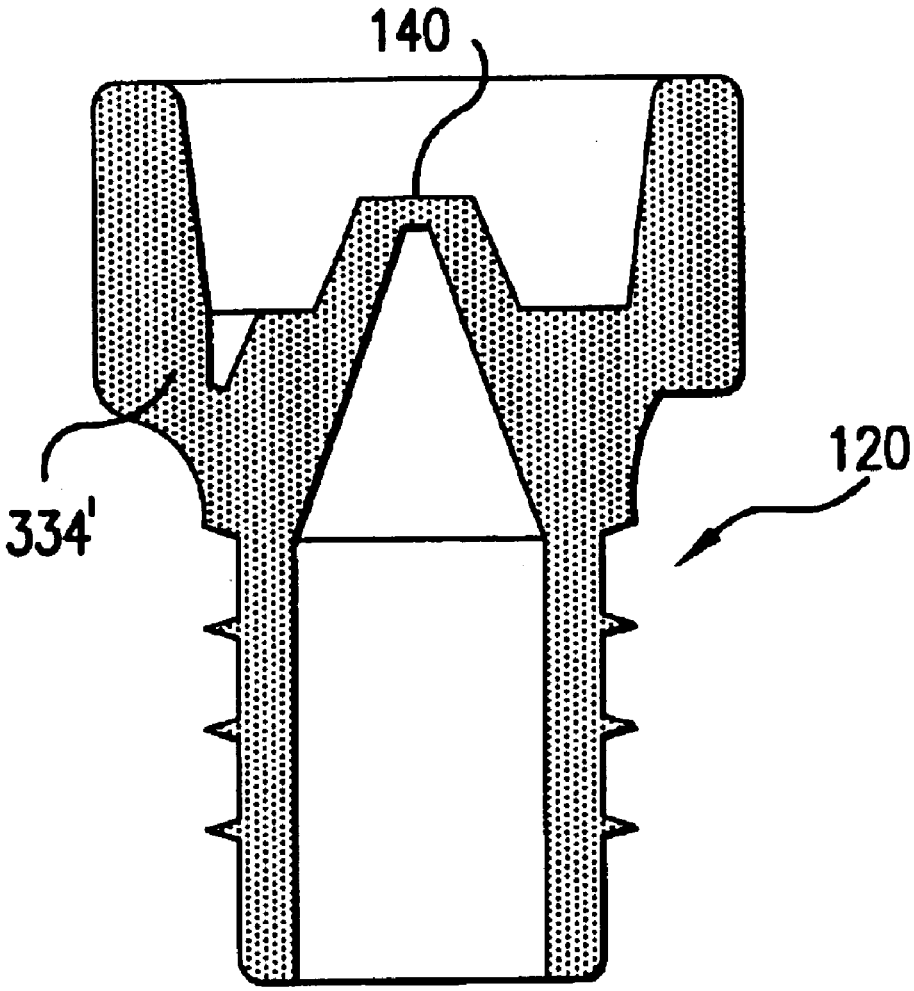
FIG. 33 is a side elevation view of the closure for use with the pump assembly of FIG. 13.

Referring to FIG. 33, there is illustrated the beverage bottle closure, generally designated by reference numeral 120'. The closure 120' is similar to the closure shown in FIGS. 11 and 12 for a similar function with the valve 140, but the exhaust port 152 as shown in the proceeding embodiment has been eliminated. The base portion 334' in FIG. 31 is shown continuous without the severed section of the preceding embodiment. The outer upper periphery of closure 120' is generally cylindrical shape having a plurality of horizontal slots to create a seal with the wall projection 232 of base 222. Opposed flat surfaces are also provided on upper outer periphery to aid insertion and removal from the bottle.

Referring to FIGS. 13 and 14 a valve 320 and a valve cap 322 is shown mounted on the base 222. The valve 360 is mounted above an exhaust port in base 222 to exhaust air to the atmosphere. The construction of valve 360 and valve cap 362 is similar to the valves and valve caps disclosed in copending U.S. non-provisional application Ser. No. 09/592,717 filed Jun. 6, 2000. The valve 360 is formed having a circular cutout area 366 forming central portion 368*a* disposed adjacent circular periphery 368. A central passage is in fluid communication with cutout area 368 and extends for approximately 270 degrees. A portion 372 of central portion 368*a* is thinner in cross-section to allow flexure of portion 3368*a*. The valve cap 362 is inserted into the cavity 360*a* of valve 360 and includes central port 364. In the upward stroke of the diaphragm, the central portion 368*a* contacts the central port 364 to block the port. In the downward stroke, the central portion 368*a* is flexed and displaced to allow air through passage 364 and out the exhaust port in the base 222. In exhausting air, the valve makes a hissing sound serving as an indicator that air is being removed from the bottle. After two or more strokes of the diaphragm, the valve 360 will not open and the hissing sound will not be heard indicating to the user that evacuation of the bottle has occurred.

In operation the pump assembly 200 is attached to a previously opened beverage bottle after the closure 320 has been inserted in the neck of the bottle. The pump assembly 200 is affixed to the closure 320 by inserting the inner hollow projection 230*a* of base 222 into the cavity 326 of the closure 320. The inner perimeter of closure 320 contact the inner wall engages housing 4 around the outer perimeter of base 222 to produce a seal. In use the pump lever 290 is squeezed such that lever arm 282 causes the rollers to move upward in track 214 generally near enclosed upper end 264. The diaphragm rod 270 simultaneously pulls diaphragm 238 upward to stretch it and reduce the pressure within the diaphragm chamber 233*a*. In the upward stroke valve 360 remains closed while valve 340 of the closure 320 opens to pull air out of the bottle to evacuate the air from the bottle. Upon release of pump lever 290, the diaphragm 38 returns to its original configuration and pulls the rollers downward in the track 214. On the down stroke valve 340 closes to seal the bottle and valve 360 opens to exhaust the air from the diaphragm chamber 333*a*. It should be apparent the diaphragm 338 not only evacuates the bottle, but serves as a seal while the valve 340 is open. The pump assembly 200 can undergo multiple strokes if greater evacuation and depressurization of the bottle is desired. Upon depressurizing the bottle the pump assembly 200 is removed while the closure 320 is in a sealed relationship on bottle whereby valves 340 assumes its normal closed mode.

What is claimed is:

1. A pump assembly for depressurizing a bottle having a neck comprising closure means for attachment to the neck of the bottle, said closure means having valve means for depressurizing the bottle and creating a seal after depressurizing the bottle, a hollow housing means for removable attachment to said closure means upon being attached to the neck of the bottle, a stretchable diaphragm being mounted in said housing means and forming a expandable chamber above said closure means, and;

said stretchable diaphragm having an outer periphery attached to said housing means, an actuator means being operatively connected to said diaphragm for stretching said diaphragm to expand said expandable chamber for depressurizing the bottle through said valve means of said closure means.

2. The pump assembly according to claim 1 wherein said housing means includes a hollow projection for creating a seal with the periphery of said closure means.

3. The pump assembly according to claim 2 wherein said valve means includes a flexible port to permit air in the bottle to be exhausted as the diaphragm is stretched.

4. The pump assembly according to claim 1 wherein said housing means includes a valve for exhausting air to the atmosphere from the expanding chamber.

5. The pump assembly according to claim 4 wherein said stretchable diaphragm includes a continuous partial circular U-shaped section.

6. The pump assembly according to claim 1 wherein actuator means includes a pump lever pivotally attached to a lever arm, said lever arm being attached to said diaphragm means for providing movement during stretching.

7. The pump assembly according to claim 1 wherein said closure means includes a lower projection for insertion into the neck of the bottle in sealed relationship, and an upper portion for removable attachment of said housing means.

8. The pump assembly according to claim 7 wherein said lower projection includes at least one ring to engage the neck of the bottle in sealing relationship.

9. The pump assembly according to claim 1 wherein said housing means includes a pair of concentric cylindrical projections for attachment to said closure means.

10. The pump assembly according to claim 9 wherein said closure means includes a upper circumferentially extending circular wall for being positioned between said pair of concentric projections during said attachment.

11. The pump assembly according to claim 1 wherein said valve means makes hissing sound during depressurization of the bottle, said hissing sound stopping upon generally complete depressurization of the bottle.

12. A pump assembly for depressurizing a bottle having a neck comprising closure means for attachment to the neck of the bottle, said closure means having valve means for depressurizing the bottle and creating a a seal after depressurizing the bottle, a hollow housing means for removable attachment to said closure means upon being attached to the neck of the bottle, a stretchable diaphragm being mounted in said housing means, an actuator means being operatively connected to said diaphragm for stretching said diaphragm to create an expanding chamber for depressurizing the bottle through said valve means of said closure means, and diaphragm rod means being attached to said diaphragm means and said actuator means, said diaphragm rod means having means for providing movement relative to housing, said housing having track means for receiving said means to provide movement.

13. The pump assembly according to claim 12 further including a spring affixed to said housing and said means for providing movement to remove slack from said diaphragm means while being stretched.

14. The pump assembly according to claim 12 wherein said rod means is a rod having a lower end attached to said diaphragm and an upper end attached to said means for providing movement.

15. A pump assembly for depressurizing a bottle having a neck comprising closure means for attachment to the neck of the bottle, said closure means having valve means for depressurizing the bottle and creating a seal after depressurizing the bottle, a hollow housing means for removable attachment to said closure means upon being attached to the neck of the bottle, a stretchable diaphragm being mounted in said housing means, an actuator means being operatively connected to said diaphragm for stretching said diaphragm to create an expanding chamber for depressurizing the bottle through said valve means of said closure means said housing means includes a valve for exhausting air to the atmosphere from the expanding chamber, said stretchable diaphragm includes a continuous circular U-shaped section, and said diaphragm includes a pair of inverted U-shaped sections adjacent to said rod means.

16. A pump assembly for depressurizing a bottle having a neck comprising closure means for attachment to the neck of the bottle, said closure means having valve means for depressurizing the bottle and creating a seal after depressurizing the bottle, a hollow housing means for removable attachment to said closure means upon being attached to the neck of the bottle, a stretchable diaphragm being mounted in said housing means, and;

an actuator means being operatively connected to said diaphragm for stretching said diaphragm to create an expanding chamber for depressurizing the bottle through said valve means of said closure means, and said housing has a pair of interconnected halves, said halves having respective edges being in contact for forming said hollow housing, said respective edges having continuous offset lips contacting each other in side by side relationship.

* * * * *